United States Patent [19]

Eriksson

[11] Patent Number: 4,732,335

[45] **Date of Patent: * Mar. 22, 1988**

[54] APPARATUS FOR TREATING CELLULOSE PULP WITH INTERMESHING DISKS AND ASSYMETRICAL PULP MOVING MEANS

[75] Inventor: Erik F. Eriksson, Johanneshov, Sweden

[73] Assignee: Aktiebolaget Frotator, Johanneshov, Sweden

[ * ] Notice: The portion of the term of this patent subsequent to Apr. 7, 2004 has been disclaimed.

[21] Appl. No.: 882,967

[22] Filed: Jul. 7, 1986

Related U.S. Application Data

[63] Continuation of Ser. No. 675,219, Nov. 27, 1984, abandoned.

[30] Foreign Application Priority Data

Nov. 30, 1983 [SE] Sweden ..... 83066166

[51] Int. Cl.[4] ..... D21D 1/34; B02C 19/00

[52] U.S. Cl. ..... 241/261; 162/261

[58] Field of Search ..... 162/261; 241/260.1, 241/261, 247, 251

[56] References Cited

U.S. PATENT DOCUMENTS 807,228 12/1905 Wurster ..... 241/292
1,532,649 4/1925 Bieber ..... 241/251
2,722,163 11/1955 Cumpston, Jr. ..... 241/186.4
4,284,247 8/1981 Eriksson ..... 241/260.1
4,339,084 7/1982 Eriksson ..... 241/260.1
4,655,406 4/1987 Eriksson ..... 241/261

FOREIGN PATENT DOCUMENTS 961673 11/1949 France .

*Primary Examiner*—S. Leon Bashore
*Assistant Examiner*—K. M. Hastings
*Attorney, Agent, or Firm*—Witherspoon & Hargest

[57] ABSTRACT

An apparatus for treating cellulose pulp having a consistency above the flowage limit provided with two shafts (1, 2) rotating in the same axial plane and each carrying working disks (8) the cylinders of rotation of which are in mutually intermeshing engagement in a working zone and which are driven within a housing (3) which conforms to the common cylinder-of-rotation space of the disks carried by the shafts and is provided with a pulp inlet (4) and a pulp outlet (5). The working disks are constituted of a number of radially directed disks in mutually co-operative positions for working of the pulp between opposed disk surfaces (11, 12), the pulp being fed from the inlet to the outlet with the aid of mutually co-operating feeding screw threads (9) carried by the shafts.

19 Claims, 19 Drawing Figures

APPARATUS FOR TREATING CELLULOSE PULP WITH INTERMESHING DISKS AND ASSYMETRICAL PULP MOVING MEANS

This application is a continuation of application Ser. No. 675,219, filed Nov. 27, 1984, now abandoned.

FIELD OF THE INVENTION

The invention relates to an apparatus for treating cellulose pulp having a consistency above the flowage limit, said apparatus being provided with two shafts rotating in the same axial plane and each carrying working means mutually intermeshing in their cylinders of rotation in a working zone and driven in a housing which closely fits to the common cylinder-of-rotation space of the means carried by the shafts and is provided with a pulp inlet and a pulp outlet.

DESCRIPTION OF THE PRIOR ART

A presently generally used apparatus of the above indicated type comprises two intermeshing rotary screws coupled for synchronized rotation in mutual interaction, the material intended to be treated, for example pulp supplied at the inlet, being conveyed by the co-operation of the screws towards the outlet and being treated during passage through the space bounded by the thread portion of the screws and the surrounding housing towards the outlet. In this case the treatment is performed between opposed surfaces of the two co-operating screws.

An apparatus of the type as indicated above, but provided with working means in the form of disks mutually intermeshing in their cylinders of rotation rather than mutually intermeshing screws has been proposed for about 80 years ago in Swedish Patent No. 21 004. However, this apparatus has been explicitly designed for treating a pulp of flow concentration enabling the pulp to be conveyed from the inlet to the outlet under the action of gravity. The use of such an apparatus for treating high-concentration pulp having a consistency above the flowage limit has never been proposed, obviously for the reason that the problem to perform an even and uniform transport of the pulp from the inlet through the working zone to the outlet has been considered insurmountable.

SUMMARY OF THE INVENTION

The present invention is based on the surprising discovery that also pulp having a consistency above the flowage limit by means of feeding members not taking part in the working can be forced to pass in an even flow and without clogging through a working zone between working means carried by two shafts and mutually intermeshing in their cylinders of rotation, said working means being in the form of radially directed disks. By the apparatus construction according to the invention, the characteristic features of which appear from the attached claims, a construction is obtained which in many respects is cheaper, more easily handled and more efficient than the doublescrew apparatus while at the same time the working effect not only is equivalent to the working principle of the old type of apparatus but rather considerably superior due to the possibility to perform several types of adjustment of the depth of engagement and the width of the treating gap between co-operating working means permitted by the novel type of apparatus and not feasible in an apparatus in which the working is performed between mutually intermeshing screw threads. Thus, said parameters may be controlled easily and at short notice when, for example, a change in the physical properties of the pulp occurs during operation.

The new apparatus construction also eliminates several of the most difficult problems of the double-screw apparatus, in particular due to the fact that the novel apparatus with particular advantage is combined with a disposition of the pulp outlet in a lateral direction at an angle to the general direction of feed of the pulp through the apparatus.

BRIEF DESCRIPTION OF THE DRAWINGS

The invention will be explained in detail in connection with several embodiments shown in the attached drawings in which.

DESCRIPTION OF THE PREFERRED EMBODIMENT

Figure 1:
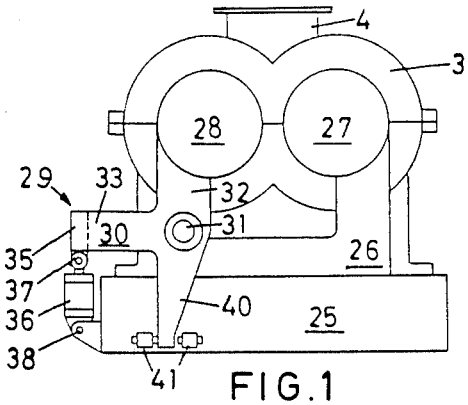
FIG. 1 is an end view towards the outlet end of an apparatus according to the invention for treating cellulose pulp.
Figure 2:
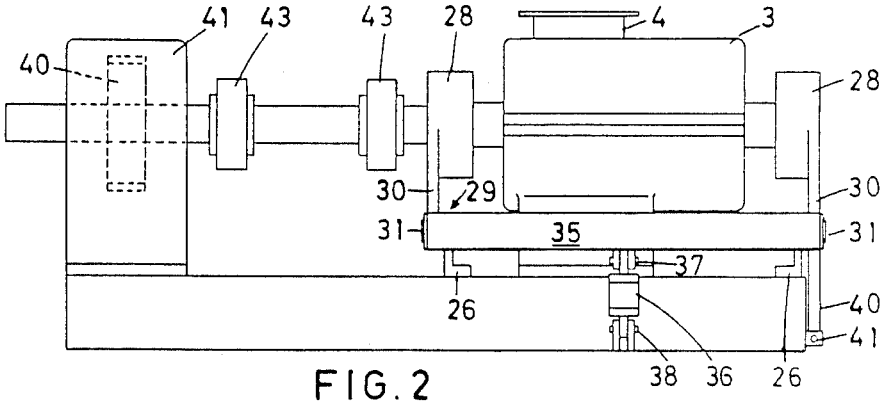
FIG. 2 is a side view of the same apparatus.
Figure 3:
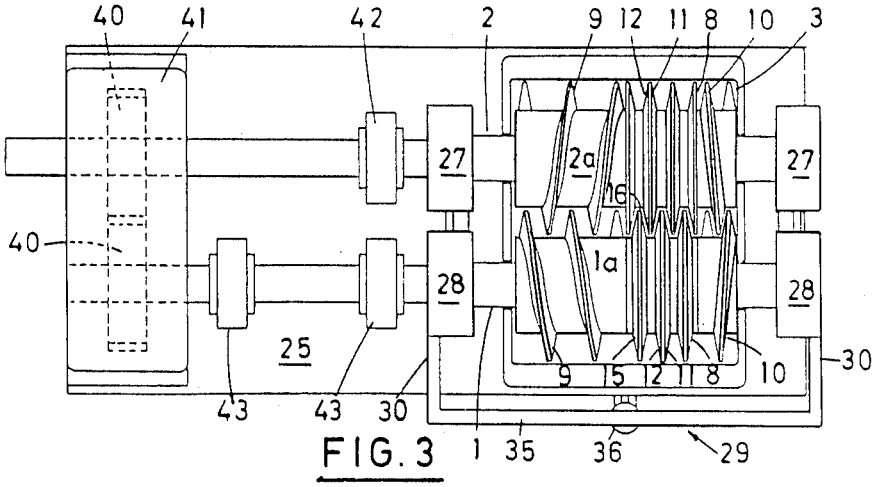
FIG. 3 is a plan view of the apparatus with the upper portion of the housing removed.

FIGS. 1 to 4 show an apparatus for treating cellulose pulp the essential portions of which are two shafts 1, 2 rotatably supported in the same axial plane and surrounded by a housing 3 having a pulp inlet 4 at the upper side close to the end wall to the left in FIG. 3 and a pulp outlet 5 on the lower side close to the opposite end wall. A mounting bed 25 carried schematically shown upright bearing supports 26 for supporting the bearings 27 of at least one 2 of the shafts.

While in the simplest possible embodiment of the apparatus also the other shaft 1 might be supported in the same way by correspondingly supported bearings, FIGS. 1 to 4 show an advantageous modification in which the bearings 28 of the shaft 1 situated below in FIG. 3 are supported on a cradle 29 which permits an adjustment of the spacing between shafts 1 and 2 by parallel shift of shaft 1. The cradle 29 itself comprises two end walls 30 which are pivotally journalled at 31 in the bearing supports 26 supporting bearings 27 of the second shaft 2 at a position below the part of housing 3 in which shaft 1 operates. On each end wall 30 an arm 32 extends in an upward direction from the journal 31 to carry one of the bearings 28 of shaft 1. Approximately at right angles to the arm 32 carrying the bearing 28 and on the same level as the journal 31 the end wall 30 comprises a horizontal arm 33. The two arms 33 horizontally extending from journals 31 on either end wall 30 are mutually connected by a cross beam 35. The cradle formed by cross beam 35 and end walls 30 as well as the bearings 28 carried by end wall arms 32 form a stiff unit that may be swung about the common axial line of journals 31. A hydraulic or pneumatic adjusting device 36 is at its one end pivotally connected to the lower side of cross beam 35 by a pivotal bearing 37 and at the other end to the mounting bed 25 by a pivotal bearing 38. During extension and retraction respectively of the moving part of the pneumatic or hydraulic device 36 the unit comprising cradle 29, bearings 28 and shaft 1 carried by the bearings will be swung respectively towards and away from shaft 2 for adjustment of the working distance between the shafts.

Obviously, it is important to prevent excessive swinging movements of shaft 1 to avoid contact between the working means carried by shaft 1 with respectively corresponding means on shaft 2 or the housing. For this reason the end wall 30 at the right-hand end of the housing as seen in FIG. 3 is extended in a downward direction from the journal 31 by an arm 40 the free end of which is positioned between adjustable abutments 41 limiting the amplitude of the swinging movement of the cradle.

As the amplitude of swinging movement is rather small it is sufficient that the passage openings for shaft 1 in the end walls of housing 3 are widened to a corresponding extent and sealed by gaskets (not shown) which are resilient or adapted to be shifted in the swinging direction of the shaft.

Shafts 1 and 2 are coupled for synchronous operation with the aid of gears 40 enclosed in a gearbox 41. Shaft 2 is extended beyond the gearbox 41 for connection to a common driving motor (not shown). While shaft 2 in the normal way is subdivided by a simple universal joint 42, two such universal joints 43 are provided on that part of shaft 1 which extends between bearing 28 and gearbox 41. The obvious purpose of this construction is to absorb any lateral shift on the part of shaft 1 between the bearings 28 during swinging movement of the cradle without exposing the bearings in gearbox 41 to undue stresses.

Within housing 3 shafts 1 and 2 carry working means 8, feeding means 9 and counter-pressure means 10.

The working means comprise a number of radially directed disks 8 in mutually co-operating positions between a pulp inlet 4 on the upper side of the housing and a downwardly directed pulp outlet 5 for compressive and kneading working of the pulp within a working zone between opposed disk surfaces 11, 12 on disks 8 mutually intermeshing in their cylinders of rotation and carried by one of the shafts 1, 2 each.

In the embodiment shown the means for feeding the pulp from the inlet through the working zone to the pulp outlet comprises feeding screw threads 9 mutually intermeshing in their cylinders of rotation and supported on sections 1*a* and 2*a* of shafts 1, 2 situated upstream of disks 8 in the direction of pulp feed. To facilitate the feeding of the pulp through the working zone means positioned asymmetrically in relation to opposed surfaces 11, 12 on mutually intermeshing disks 8 may be provided for moving pulp enclosed between opposed disk surfaces 11, 12 in the direction towards the pulp outlet.

Figure 12:
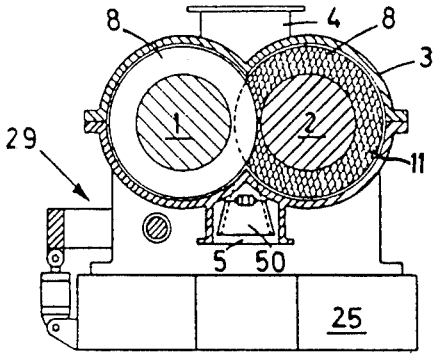
FIG. 12 is a sectional view of an embodiment of the present invention.
Figure 13:
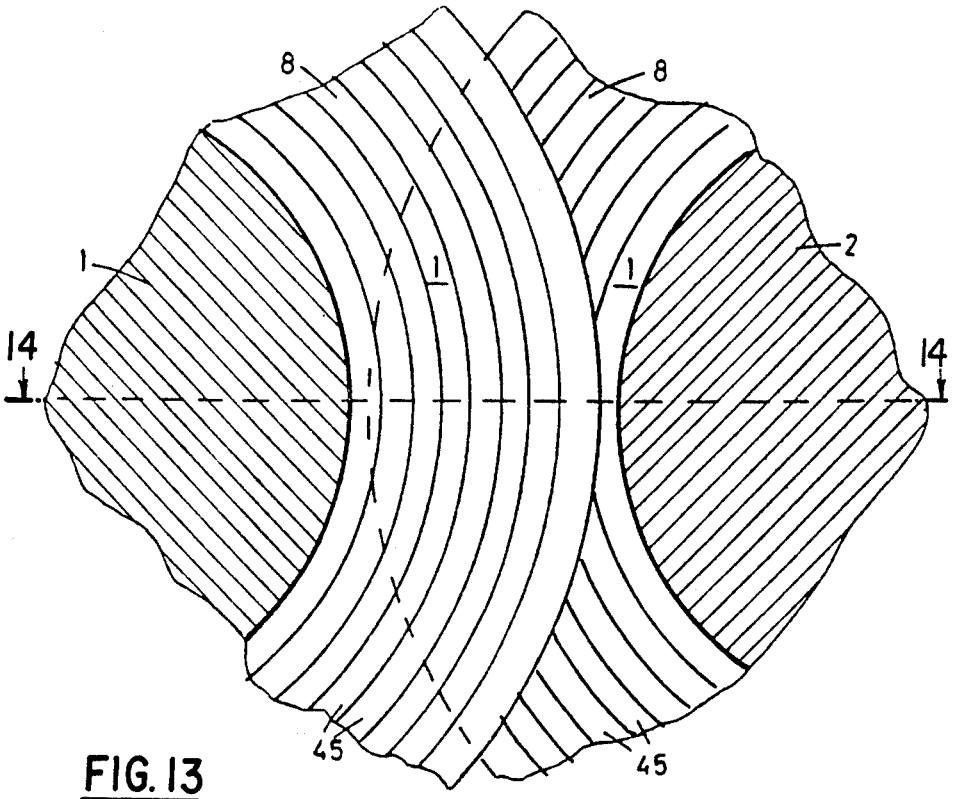
FIG. 13 is a partial view to an enlarged scale of the range of intermesh between two disks supported by one of the shafts
Figure 14:
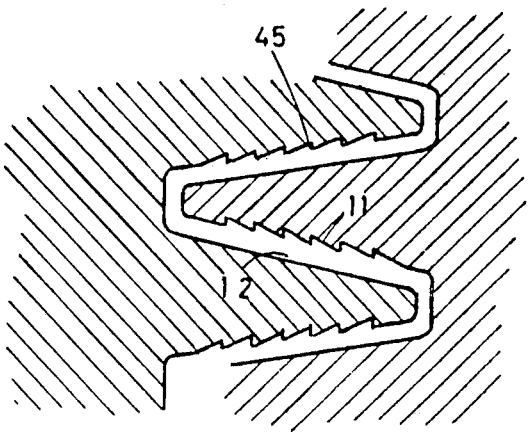
FIG. 14 is a section along line 14—14 in FIG. 13.

In a first embodiment which is generally indicated in FIG. 12 and shown in detail in FIGS. 13 and 14 disks 8 carry said means on their sides 11 facing the pulp outlet 5 in the form of pulp-engaging projections, profiles or edges. In FIG. 12 these sides on the disks facing outlet 5 are shown provided with some kind of rugged structure which increases the friction of the disk side in relation to the treated material whereas opposed disk sides 12 are substantially plain. Already a rather small difference in the engagement between respectively rugged and plain disk sides produces a stepwise advance of pulp portions in the direction towards the lesser frictional resistance on the plain disk sides 12 facing away from the outlet and thereby a feeding movement from the inlet 4 to the outlet 5. The effect will appear at any difference in the frictional engagement of opposed disk sides in relation to the pulp but may be increased by a particular design of the forward-feeding sides 11 which may be provided with projections, profiles or edges in contrast to the opposed sides 12 which are plain or possibly profiled in such a way that a shifting of the pulp in the desired direction is promoted.

As an example of a suitable profile FIGS. 13 and 14 show an embodiment of sides 11 of disks 8 comprising concentric edges 45 in a stair-step like succession.

It is important to prevent sticking of worked pulp between the end wall of the housing 3 at the outlet 5 and the disks 8 positioned closest to said end wall. For this reason, the last disks on the shafts have the distribution of rugged and plain surface reversed in relation to the disks 8 positioned between the opposite end wall and the outlet. While the two last disks 8 on shaft 2 thus have two mutually opposed rugged surfaces, the intermediate disk 8 on shaft 1 has plain surfaces on both sides. Thus, there will be no forward feed of the pulp by differential frictional action but the pulp will be diverted straight downwardly in the direction of the outlet.

Figure 15:
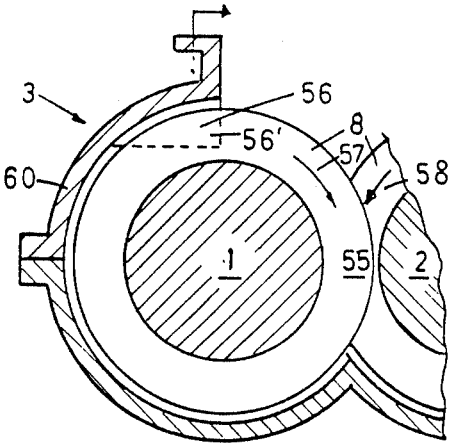
FIG. 15 is a radial partial section of the range of intermesh between two disks showing a second embodiment of the means serving to move the pulp in the direction towards the outlet.
Figure 16:
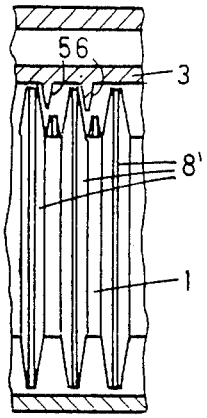
FIG. 16 is a side view of the same range with the side wall portions of the housing cut-away.

A second embodiment of the means shifting the pulp in the direction towards the pulp outlet 5 is shown in FIGS. 15 and 16 where these means are guide rails 56 extending from the inner surface of housing 3 at a distance from the range of intermesh 55 between disks 8 in the interspace between adjacent disk 8' on respectively shaft 1 or shaft 2, said guide rails 56 due to their asymmetric position in relation to adjacent disk 8' on the same shaft causing the pulp to move in a path leading towards the pulp outlet. In FIG. 15 the direction of rotation of shaft 1 and 2 is indicated by arrows 57, 58. It appears from the side view of FIG. 16 that pulp taking part in the rotation between two adjacent disks 8' on shaft 1 when moving past guide rails 56 will be shifted in a direction towards the outlet 5 to the right in FIG. 16 and will fall down into the interspace between the meeting pair closest to the right of adjacent disks 8' on shaft 2. This shifting movement towards the outlet 5 continues in consecutive steps so that a great portion of the pulp rotating together with the disks all the time will be shifted closer to the outlet.

Figure 4:
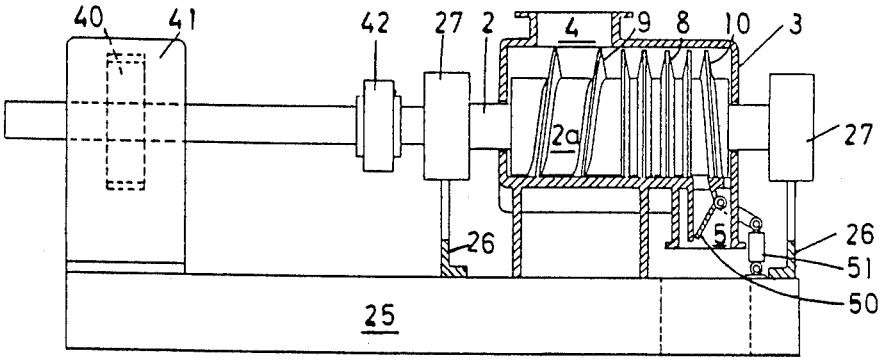
FIG. 4 is a side view of the apparatus with the housing shown in section and the shaft shown below in FIG. 3 together with its bearings, couplings and driving means removed.
Figure 5:
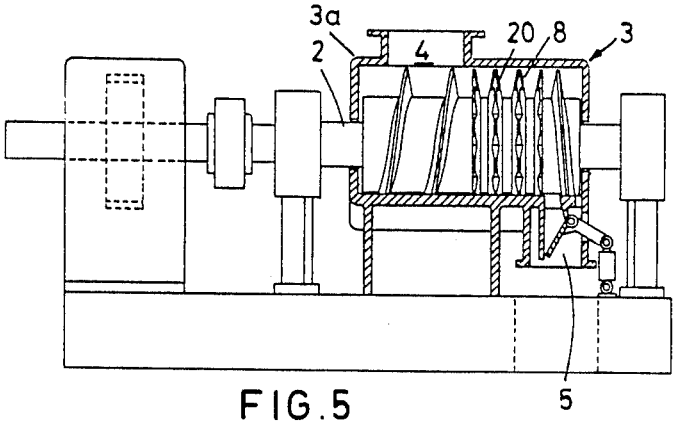
FIG. 5 is a view substantially corresponding to FIG. 4 of an apparatus with a modified embodiment of the working disks.
Figure 6:
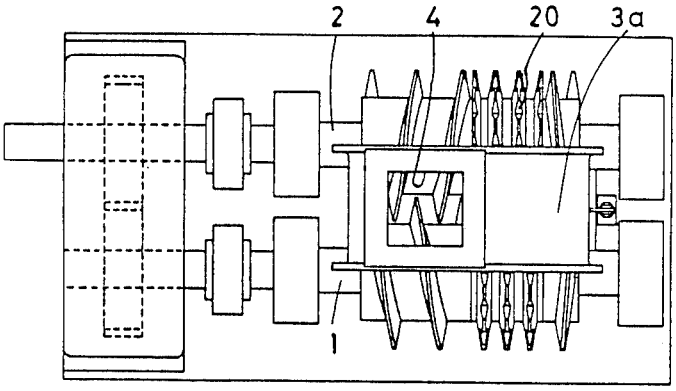
FIG. 6 is a plan view of the same device with the side portions of the housing removed.
Figure 7:
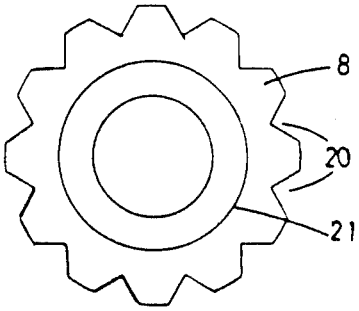
FIG. 7 is a plan view of a treating disk of the type forming part of the embodiment according to FIGS. 5 and 6, FIGS. 8 and 9 are respectively a side view and a perspective view of three disks according to FIG. 7 provided on the same shaft.
Figure 8:
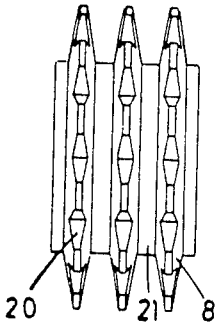
Figure 9:
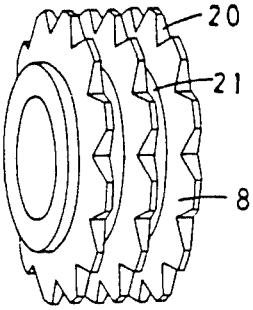

In the same way as in the feeding profile of the embodiment according to FIG. 4, also in this embodiment according to FIGS. 15 and 16 guide rails 56 having an asymmetric position opposed to the rest of the guide rails may be provided at the outlet and of housing 3 to perform a counter-pressure guiding of the pulp for the purpose of its discharge through the pulp outlet 5. Hereby the risk is avoided that a compact accumulation of pulp is formed in the zone bounded by the end wall of the housing on the discharge side and the disks positioned adjacent this end wall.

It is to be observed that the position of the guide rails 56 is not only asymmetric in relation to two adjacent disks 8' on either of shaft 1 or 2 but also in relation to co-operating pairs of disks 8 on each of shafts 1 or 2. Thus, the guide rails 56 are not symmetrical in relation to the axial lines of two such co-acting disks but extend from the wall of housing 3 in parallel with the common axial plane of the two shafts to form an end edge 56' which in the embodiment shown is disposed exactly above the axial line of adjacent shaft 1.

As the guide rails are exposed to comparatively strong wear, they are supported in the embodiment shown in FIGS. 15 and 16, by a particular, easily detachable and exchangeable part of the housing wall extending over about a fourth of the perimeter of the disks.

Figure 17:
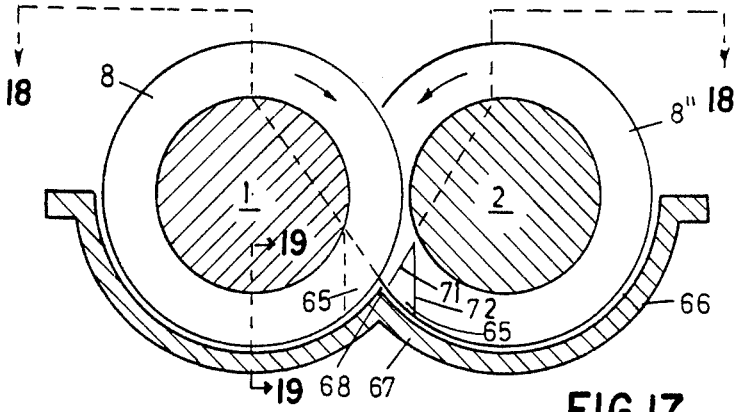
FIG. 17 is a radial section of the range of intermesh between two disks each supported by one of the shafts showing a third embodiment of means for shifting the pulp towards the pulp outlet.
Figure 18:
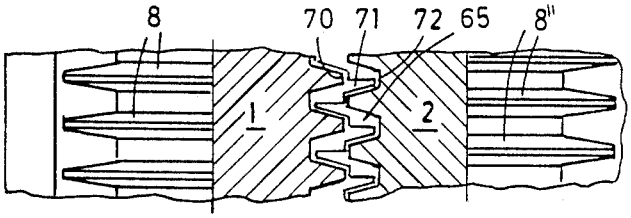
FIG. 18 is a partial section along line 18—18 in FIG. 17.
Figure 19:
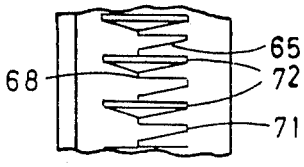
FIG. 19 is a partial view of the bottom of the housing with the shaft and disks removed and the housing sectioned along line 19—19 in FIG. 17.

In FIGS. 17 to 19 a third embodiment is shown of means disposed asymmetrically in relation to opposed surfaces on mutually intermeshing disks thereby causing pulp enclosed between opposed disk surfaces to be shifted in the direction towards the pulp outlet. In this embodiment said means are in the form of guide fins extending from the inner surface of housing 3 adjacent the periphery of either disk 8 on respectively shaft 1 or 2 into the interspace between adjacent disks 8 on the other shaft 2 and 1 respectively, said guide fins 65 diverting the pulp against that side of the disk 8 entering into the interspace which is facing the pulp outlet.

In the embodiment shown the guide fins 65 are attached to the central part 67 of the bottom 66 of the housing, which central part 67 due to the shape of the bottom in agreement with the common cylinder-of-rotation space of the two disk sets forms an edge 68 extending in parallel to the axial lines of the shafts. An edge 71 on every guide fin 65 positioned opposite the peripheral edge 70 of a disk 8 merges at the longitudinal bottom edge 67 in a soft transition into the inner surface of bottom 66 that follows the periphery of disk 8, whereas the opposite free edge 72 of the guide fin 65 extends straight down in the interspace between two adjacent disks 8'' opposed to the first-mentioned disk 8. Pulp enclosed between two disks 8'' which in the range of intermesh meets the edge surface 71 of guide fin 65 will thus be diverted into the interspace closer to the outlet between opposed disk pairs 8 and so on.

FIG. 19 illustrates the shape of a set of guide fins 65 when the disks 8 are removed.

Also in this embodiment of the means for moving pulp enclosed between opposed disk surfaces towards the pulp outlet it is possible to provide beyond the outlet the guide fins 65 in an asymmetric position which is contrary to the position of the rest of the guide fins thereby to produce a counter-pressure shifting of the pulp away from the end wall of housing 3 on the outlet side and into the pulp outlet 5.

Obviously several of the means provided for moving the pulp into the direction towards the pulp outlet may be combined in the same apparatus in order to increase the shifting effect. It is also possible to use a counter-pressure means, in place of oppositely asymmetric means of the above described type, counter-pressure screw threads on shafts 1, 2, such screw threads preferably being in mutual intermeshing engagement and being supported on shafts 1, 2 beyond the last disks 8 in the direction of feed on both shafts 1 and 2.

In the embodiment of the apparatus shown in FIGS. 1 to 4 the pulp outlet extends laterally in relation to the common axial plane of shafts 1 and 2 adjacent the last disks 8 in the feeding direction of the pulp on both shafts 1, 2. Obviously the outlet might also be provided in a different way, for example, in the form of an adjustable gap between the housing 3 and both shafts 1 and 2 and in concentric position in relation to the shafts.

In the embodiment shown the outlet is a tube downwardly projecting centrally between shafts 1 and 2 and, for example, having rectangular cross-section and preferably outwardly increasing cross-sectional area. The outlet is closed by a flap 50 which is pivotally journalled in the tube wall and extends in an obliquely downward direction to offer a resistance against the discharge which is adjustable by hydraulic or pheumatic means 51.

In order to prevent treated cellulose pulp from clogging against the end wall of housing 3 adjacent the outlet 5 shafts 1, 2 beyond the last working piece 8 carry reversely directed counter-pressure screw threads 10 mutually intermeshing in their cylinders of rotation. In place of such counter-pressure screw threads carried by the shafts other diverting means in firm connection with the housing or supported by the shafts might be used.

The housing 3 conforms closely to the common cylinder-of-rotation space of the means carried by the shafts such as the feeding screw threads 9, the working disks 8 and the counter-pressure screw threads 10 and leaves only so much free space around the working means, in particular disks 8, as is required in respect to the adjustibility of the one shaft or both shafts in a lateral direction in relation to the axial lines for changing the mutual depth of intermesh of the disks.

Suitably the thickness of disks 8 decreases towards the periphery. The peripheral edge of the disks might be acute but suitably each disk 8 has a peripheral edge 15 of some extension in the axial direction and spaced from an opposed bottom surface 16 between two disks 8 at a distance suitably for the treatment of the pulp. Experience has shown that such a compressive treatment between the circumferential edge 15 on one disk on the one shaft and the bottom 16 between two opposed disks on the other shaft yields a particularly efficient treatment of the pulp enclosed in the interspace.

Suitably the cross-section of disks 8 is symmetrical. However, it is sufficient that disks 8 each provided on one of shafts 1, 2 have identical bevel angle on mutually opposed surfaces, which bevel angle may be different on the two sides of the same disk. The main point is that opposed disk surfaces on disks belonging to different shafts enclose a working zone having substantially uniform thickness.

In the embodiment according to FIGS. 1 to 4 shaft 1 is adjustable by parallel shift in relation to shaft 2 with the aid of cradle 29 whereas bearings 27 for shaft 2 are stationary on the mounting bed 25. However, it is possible to provide for mutual parallel shift of both shafts 1 and 2 for adjustment of the depth of engagement between the disks on both shafts. A fully serviceable apparatus may also be obtained without providing for parallel shift of one of the shafts in relation to the other: Certain adjustment of the depth of engagement between the working means can also be obtained by providing one of the shafts angularly adjustable in relation to the other shaft in the common axial plane of the shafts. This may also be brought about by cardanically connecting the one shaft to its driving means while the opposite end of the shaft on the other side of the housing is supported for lateral shifting movement.

The embodiment of the apparatus according to FIGS. 5 to 11 is distinguished from the previously described embodiment in the first place by a modified shape of the peripheral edges of the disks. As for the rest, also this embodiment of the apparatus may be provided with the previously described arrangements for parallel shift of at least one of the shafts in relation to the other or of the angular adjustibility of the one shaft for varying the depth of interaction between co-operating working surfaces. However, these details are not shown in connection with the embodiment according to FIGS. 5 to 11.

In the embodiment according to FIGS. 5 to 11 the peripheral edge of at least some of the disks 8 on each shaft is provided with indentations 20 for forming cogs, teeth or arcuate recesses in which separate portions of the treated material are exposed to local, radial compression against the opposed groove bottom 21.

As previously described such a radial compression also occurs between flat peripheral disk edges and the opposed groove bottom but the amount of pulp treated at each such interaction between a peripheral section on a disk and the opposed groove bottom and thereby the working effect are considerably increased by providing such indentations 20.

Figure 10:
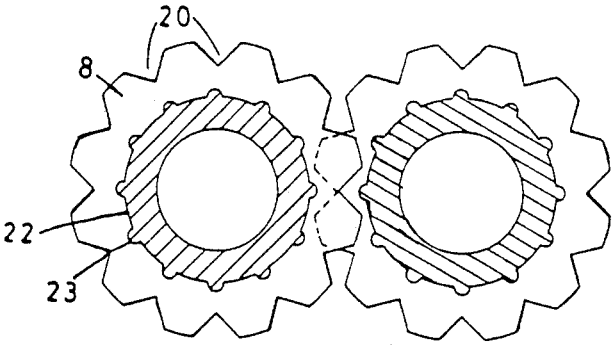
FIG. 10 is a plan view of two mutually intermeshing working disks with modified groove bottom.
Figure 11:
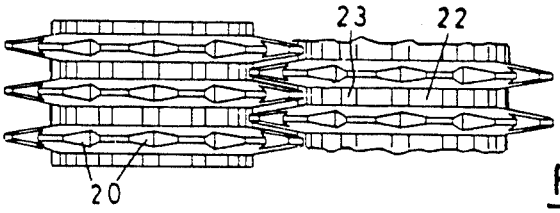
FIG. 11 is a side view of mutually intermeshing disks of the type shown in FIG. 10.

The working effect obtained by the indentations 20 may be additionally increased by adapting the profile of the groove bottom 21 to the profile of the periphery of an opposed disk 8 provided with indentations 20, such adaptation, for example, being obtained by the provision of beads 23 positioned opposite to the indentations 20 (FIGS. 10, 11).

A modification of the mode of operation of great importance for varying the operational conditions may be obtained by providing the shafts with mutually independent driving means or so coupling the shafts for common operation that they may be driven at different speeds. Obviously, this requires that the feeding screw threads as well as any counter-pressure screw threads have such as pitch or such a mutual spacing that they do not touch each other independently of the relative rotary positions of the two shafts. While the shafts in the described embodiments are driven in mutual opposite directions, it is obviously also possible to let the shafts rotate in the same direction. While the working in the first case is predominantly kneading, it is rather of a rubbing character in the other case.

The construction of the apparatus according to the invention as described permits also an adjustment of at least one of the shafts 1, 2 in the longitudinal direction for adjustment of the spacing between mutually opposed disk surfaces.

All the above-mentioned adjustments between shafts by parallel shift, angular adjustment and longitudinal shifting may be used separately or in combination to obtain the initially mentioned advantages of the apparatus according to the present invention.

For repair and maintenance purposes the housing 3 is composed of easily detachable parts. FIGS. 1 to 4 show a horizontal subdivision on the level of the common axial plane of shafts 1, 2, while the housing shown in FIGS. 5 and 6 has a central portion 3*a* in firm connection with the mounting bed and provided with inlet 4 and outlet 5 as well as removeable side portions not shown in FIGS. 5 and 6.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

What I claim is:

1. Apparatus for treating high concentration cellulose pulp having a consistency above the flowage limit, comprising two spaced shafts rotatable in the same axial plane, each shaft carrying a plurality of radially directed axially spaced disks located in mutually cooperative positions to define respective cylinders of rotation which are in mutually intermeshing engagement and form a working zone located between opposed surfaces of said disks in said mutually cooperative positions, the thickness of said disks diminishing towards the periphery thereof, said disks being located within a housing which closely conforms to the common cylinder of rotation space of said disks, said disks being positioned between a pulp inlet at one longitudinal end of said shafts and a pulp outlet at the other longitudinal end of said shafts, said inlet and outlet communicates with said working zone, said disks having inlet facing surfaces and outlet facing surfaces, means for rotating said shafts, means positioned asymmetrically in relation to said opposed surfaces for causing pulp enclosed between said opposed surfaces to move in a direction towards said pulp outlet, said pulp-moving means comprising a plurality of projections on said outlet-facing surfaces increasing the friction in relation to the treated material to a greater extent than any structure on said opposed inlet-facing surfaces, a first feeding screw thread carried by one of said shafts and being adjacent said inlet and extending from said inlet to said disks carried by said one shaft, and a second feeding screw thread carried by said other of said shafts and being adjacent said inlet and extending from said inlet to said disks carried by said other shaft, said first and second threads being oriented relative to each other for urging said pulp from said inlet towards said disks.

2. Apparatus of claim 1 wherein said threads define mutually intermeshing cylinders of rotation.

3. Apparatus of claim 2 wherein said first thread is a right handed thread and said second thread is a left handed thread.

4. Apparatus as claimed in claim 1 wherein said pulp outlet extends laterally in relation to the common axial plane of said shafts at a position adjacent the last disks on the end of said shafts in the direction of pulp feed.

5. Apparatus as claimed in claim 4 wherein means are provided beyond said last disks for diverting the pulp back towards said outlet.

6. Apparatus as claimed in claim 5 wherein said diverting means comprise first counter-pressure screw thread carried by one of said shafts and being adjacent said outlet and extending towards said disks carried by said one shaft, and a second counter-pressure screw thread carried by said other of said shafts and being adjacent said outlet and extending towards said disks carried by said other shaft, said first and second counter-pressure screw threads being oriented relative to each other for urging said pulp towards said outlet.

7. Apparatus as claimed in claim 6 wherein said counter-pressure screw threads define mutually intermeshing cylinders of rotation.

8. Apparatus as claimed in claim 7 wherein said first counter-pressure screw thread is a right handed thread and said second counter-pressure screw thread is a left handed thread.

9. Apparatus as claimed in claim 1 wherein each disk on one of said shafts comprises a peripheral edge extending in the axial direction and located at a spacing from an opposed bottom surface between two disks on the other of said shafts suitable for the working of the pulp.

10. Apparatus as claimed in claim 1 wherein said disks have a symmetrical cross-section.

11. Apparatus as claimed in claim 1 wherein said disks on at least one of said shafts are bevelled at an identical bevel angle on mutually opposed surfaces.

12. Apparatus as claimed in claim 1 wherein the peripheral edge of at least one of said disks on one of said shafts is provided with indentations forming recesses in which separate portions of the treated material are exposed to local, radial compression against an opposed groove bottom between adjacent disks on the other of said shafts.

13. Apparatus as claimed in claim 12 wherein said groove bottom has a profile adapted to the periphery of said disk.

14. Apparatus as claimed in claim 1 wherein at least one of said shafts is adjustable in the longitudinal direction for adjustment of the spacing between mutually opposed disk surfaces.

15. Apparatus as claimed in claim 1 wherein said shafts have mutually independent driving means.

16. Apparatus as claimed in claim 1 wherein said shafts are mutually coupled for synchronous operation by common driving means.

17. Apparatus as claimed in claim 16 wherein said shafts are mutually coupled for operation at different speeds.

18. Apparatus for treating high concentration cellulose pulp having a consistency above the flowage limit, comprising two spaced shafts rotatable in the same axial plane, each shaft carrying a plurality of radially directed axially spaced disks located in mutually cooperative positions to define respective cylinders of rotation which are in mutually intermeshing engagement and form a working zone located between opposed surfaces of said disks in said mutually cooperative positions, the thickness of said disks diminishing towards the periphery thereof, said disks being located within a housing which closely conforms to the common cylinder of rotation space of said disks, said disks being positioned between a pulp inlet at one longitudinal end of said shafts and a pulp outlet at the other longitudinal end of said shafts, said inlet and outlet communicates with said working zone, means for rotating said shafts, means positioned asymmetrically in relation to said opposed surfaces for causing pulp enclosed between said opposed surfaces to move in a direction towards said pulp outlet, said pulp-moving means comprising a plurality of guide rails each extending from an inner surface of said housing at a distance from said working zone and into the interspace between adjacent disks of the same shaft, said guide rails extending in a radial plane in relation to said shafts and being arranged in a asymmetric position in relation to opposed disks of the same shaft thereby to divert the pulp into a path leading to said pulp outlet, a first feeding screw thread carried by one of said shafts and being adjacent said inlet and extending from said inlet to said disks carried by said one shaft, and a second feeding screw thread carried by said other of said shafts and being adjacent said inlet and extending from said inlet to said disks carried by said other shaft, said first and second threads being oriented relative to each other for urging said pulp from said inlet towards said disks.

19. Apparatus for treating hight concentration cellulose pulp having a consistency above the flowage limit, comprising two spaced shafts rotatable in the same axial plane, each shaft carrying a plurality of radially directed axially spaced disks located in mutually cooperative positions to define respective cylinders of rotation which are in mutually intermeshing engagement and form a working zone located between opposed surfaces of said disks in said mutually cooperative positions, the thickness of said disks diminishing towards the periphery thereof, said disks being located within a housing which closely conforms to the common cylinder of rotation space of said disks, said disks being positioned between a pulp inlet at one longitudinal end of said shafts and a pulp outlet at the other longitudinal end of said shafts, said inlet and outlet communicates with said working zone, means for rotating said shafts, means positioned asymmetrically in relation to said opposed surfaces for causing pulp enclosed between said opposed surfaces to move in a direction towards said pulp outlet, said pulp-moving means comprising a plurality of guide fins each extending from an inner surface of said housing adjacent the periphery of each disk on one of said shafts into the interspace between mutually adjacent disks on the other said shafts, said guide fins diverting the pulp against that side of the disk entering into the opposed disk interspace which is facing said pulp outlet, a first feeding screw thread carried by one of said shafts and being adjacent said inlet and extending from said inlet to said disks carried by said one shaft, and a second feeding screw thread carried by said other of said shafts and being adjacent said inlet and extending from said inlet to said disks carried by said other shaft, said first and second threads being oriented relative to each other for urging said pulp from said inlet towards said disks.

* * * * *